US009629430B1

(12) United States Patent
Getahun

(10) Patent No.: US 9,629,430 B1
(45) Date of Patent: Apr. 25, 2017

(54) MOTORIZED LUGGAGE SYSTEM

(71) Applicant: Dabula Getahun, Seattle, WA (US)

(72) Inventor: Dabula Getahun, Seattle, WA (US)

( * ) Notice: Subject to any disclaimer, the term of this patent is extended or adjusted under 35 U.S.C. 154(b) by 0 days.

(21) Appl. No.: 14/959,876

(22) Filed: Dec. 4, 2015

(51) Int. Cl.
*A45C 9/00* (2006.01)
*A45C 5/03* (2006.01)
*A45C 5/14* (2006.01)
*A45C 13/26* (2006.01)

(52) U.S. Cl.
CPC ..... *A45C 9/00* (2013.01); *A45C 5/03* (2013.01); *A45C 5/14* (2013.01); *A45C 13/262* (2013.01); *A45C 2009/005* (2013.01)

(58) Field of Classification Search
CPC ..... A45C 9/00; A45C 2009/005; A45C 5/03; A45C 5/14; A45C 5/146; A45C 13/26; A45C 13/262
USPC ..... 180/291, 208, 209
See application file for complete search history.

(56) References Cited

U.S. PATENT DOCUMENTS 3,314,494 A 4/1967 Weitzner
3,316,993 A * 5/1967 Weitzner ..... A45C 5/14 180/208
D268,938 S 5/1983 Carmagnola et al.
4,913,252 A * 4/1990 Bartley ..... A45C 5/14 180/208
5,207,440 A * 5/1993 Liang ..... A45C 13/262 280/37
8,282,113 B2 10/2012 Veal et al.
8,540,252 B2 9/2013 Arjomand et al.
2004/0056442 A1 3/2004 Ostrowski et al.
2009/0315301 A1 12/2009 Athalye
2010/0231161 A1* 9/2010 Brown ..... B25H 3/02 320/101
2011/0214957 A1 9/2011 Barnard et al.
2013/0001911 A1 1/2013 Porri
2015/0034402 A1* 2/2015 Dourado ..... A45F 3/04 180/181
2016/0255928 A1* 9/2016 O'Donnell ..... A45C 5/03

FOREIGN PATENT DOCUMENTS

EP 2540604 6/2012

* cited by examiner

*Primary Examiner* — John Walters

(57) ABSTRACT

A motorized luggage system includes an article of luggage. A platform is slidably coupled to the article of luggage. The platform is extendable outwardly from the article of luggage such that the platform may be ridden upon. A drive unit is coupled to the article of luggage and the drive unit engages a support surface. The drive unit urges the article of luggage such that the article of luggage provides transportation when the platform is ridden upon.

12 Claims, 6 Drawing Sheets

MOTORIZED LUGGAGE SYSTEM

BACKGROUND OF THE DISCLOSURE

Field of the Disclosure

The disclosure relates to luggage devices and more particularly pertains to a new luggage device that may be ridden such that the luggage device provides transportation.

SUMMARY OF THE DISCLOSURE

An embodiment of the disclosure meets the needs presented above by generally comprising an article of luggage. A platform is slidably coupled to the article of luggage. The platform is extendable outwardly from the article of luggage such that the platform may be ridden upon. A drive unit is coupled to the article of luggage and the drive unit engages a support surface. The drive unit urges the article of luggage such that the article of luggage provides transportation when the platform is ridden upon.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
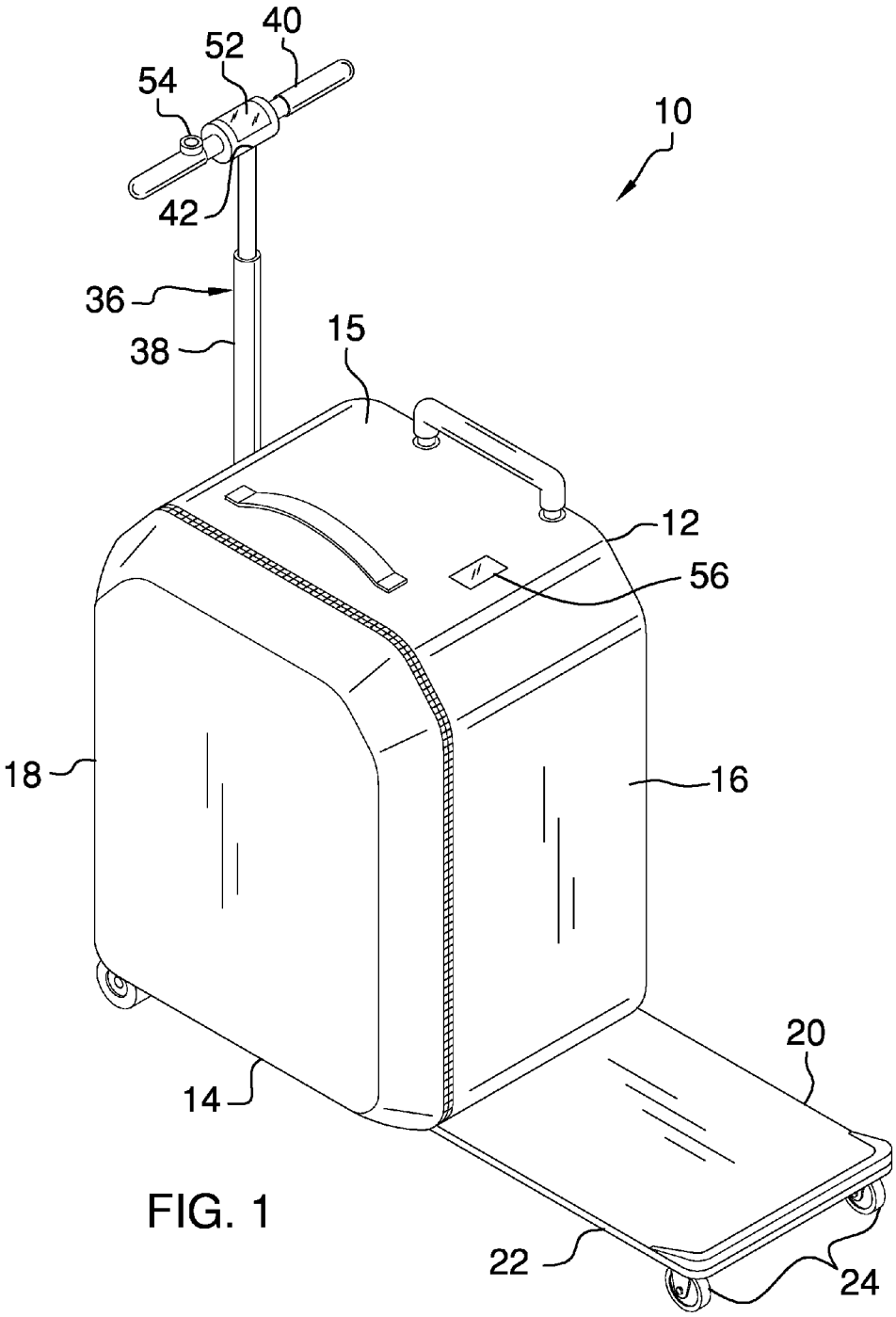
FIG. 1 is a top perspective view of a motorized luggage system according to an embodiment of the disclosure.
Figure 2:
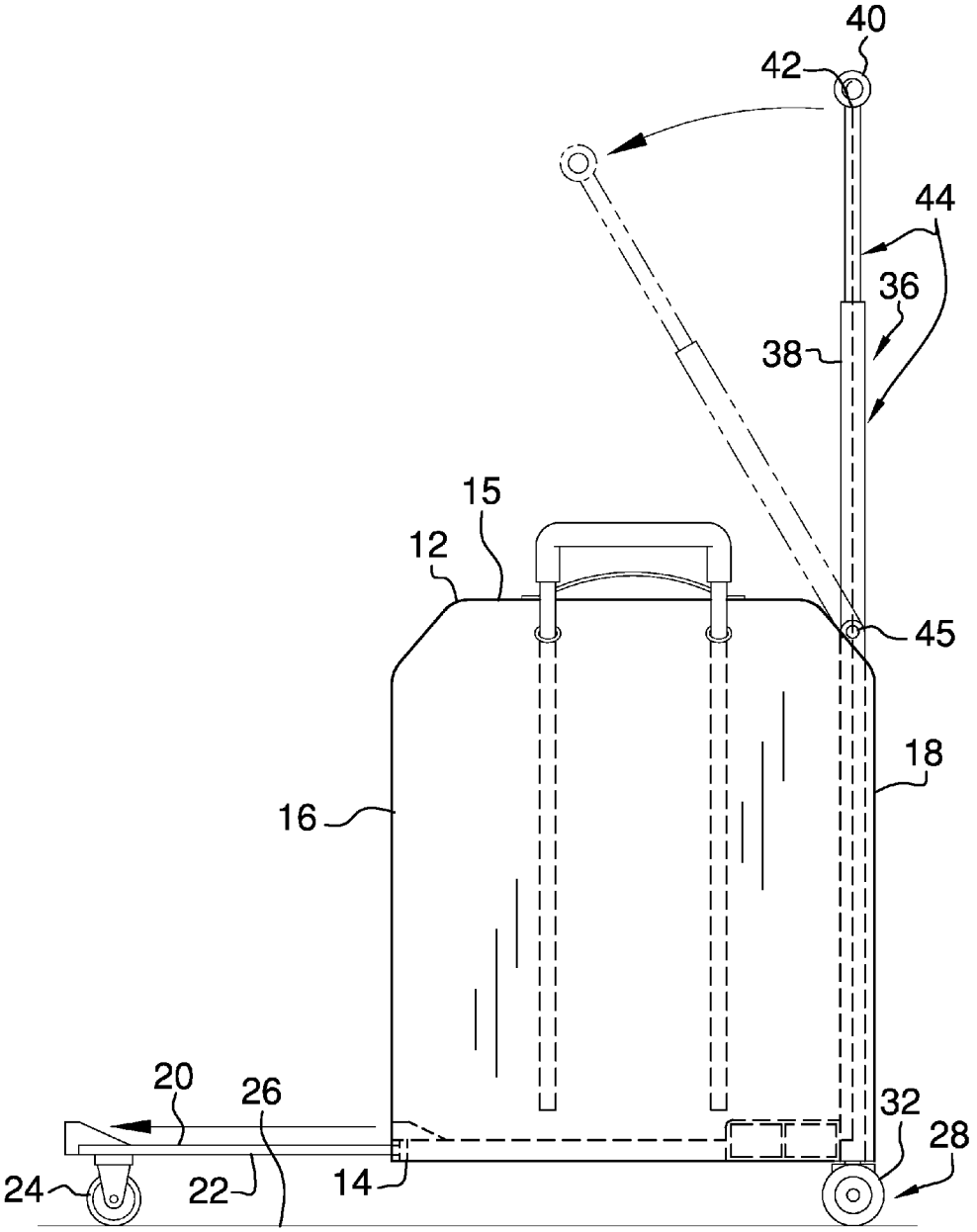
FIG. 2 is a back view of an embodiment of the disclosure.
Figure 3:
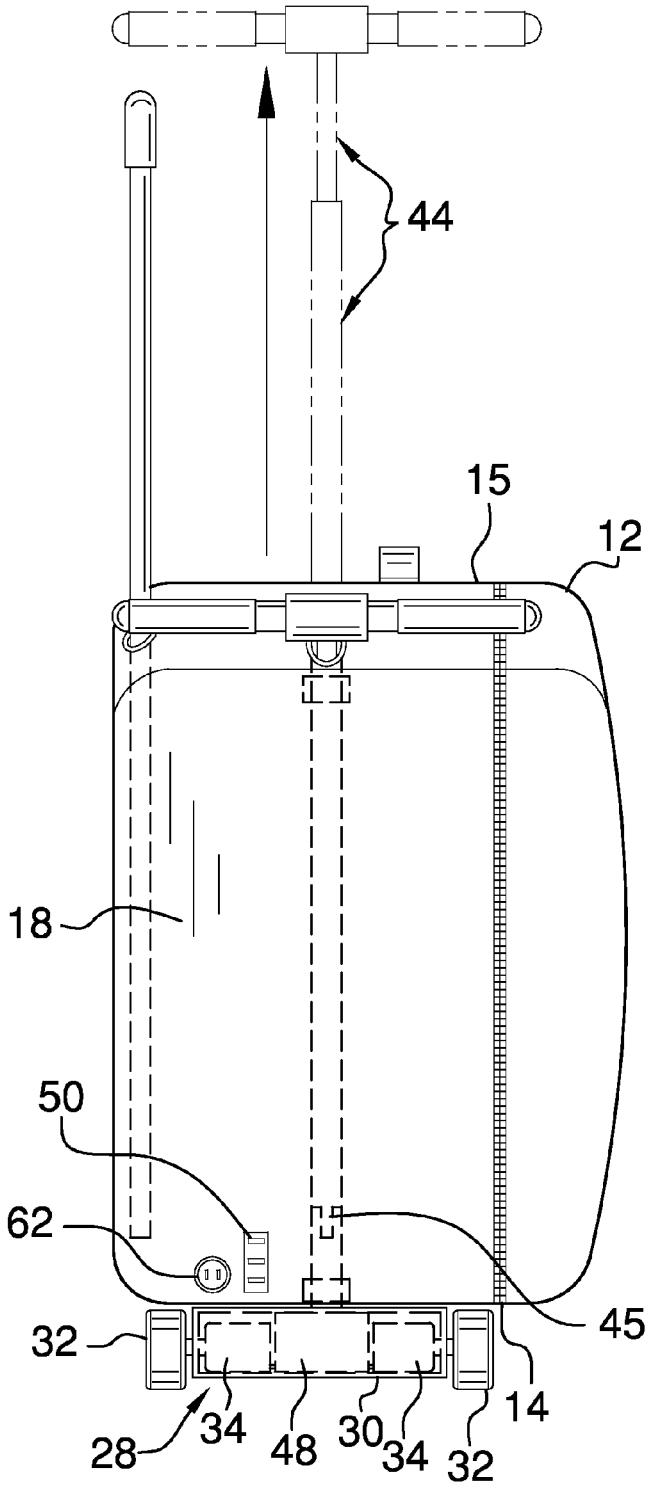
FIG. 3 is a right side phantom view of an embodiment of the disclosure.
Figure 4:
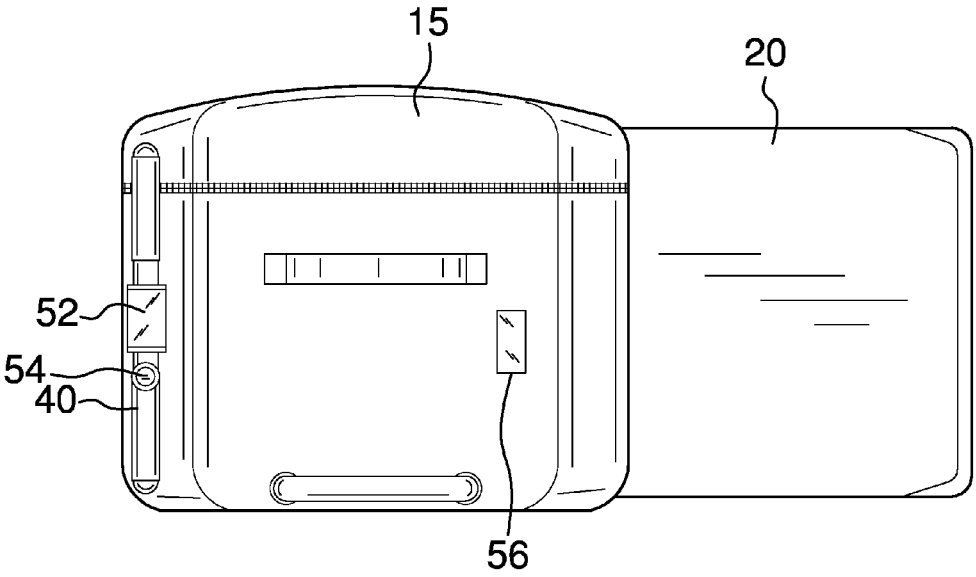
FIG. 4 is a top view of an embodiment of the disclosure.
Figure 5:
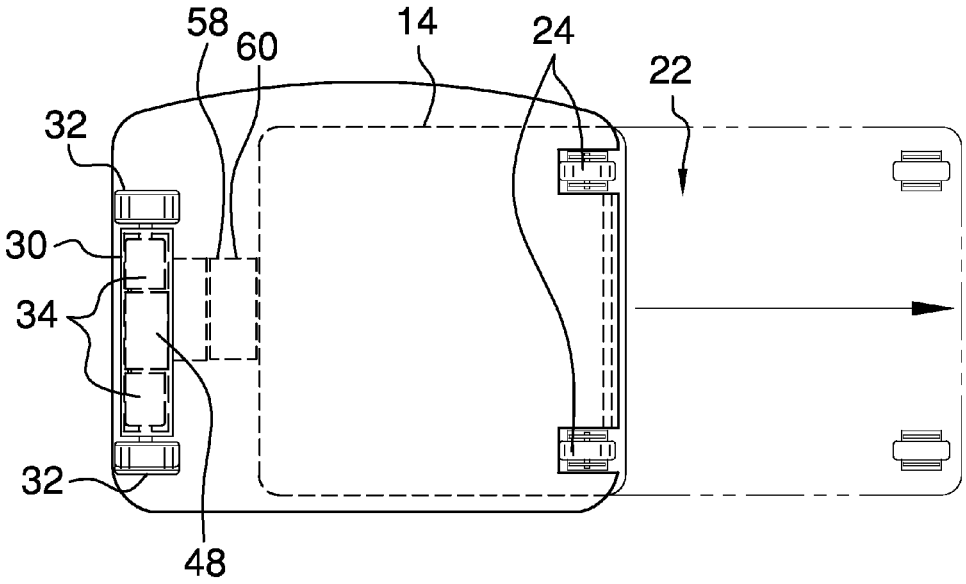
FIG. 5 is a bottom phantom view of an embodiment of the disclosure.

With reference now to the drawings, and in particular to FIGS. 1 through 7 thereof, a new luggage device embodying the principles and concepts of an embodiment of the disclosure and generally designated by the reference numeral 10 will be described.

As best illustrated in FIGS. 1 through 7, the motorized luggage system 10 generally comprises an article of luggage 12 that has a bottom side 14, a top side 15 a first lateral side 16 and a second lateral side 18. The article of luggage 12 may comprise a suitcase or the like. A platform 20 is slidably coupled to the article of luggage 12. The platform 20 is extendable outwardly from the article of luggage 12 such that the platform 20 may be ridden upon.

The platform 20 has a bottom surface 22. The platform 20 is slidable outwardly from the first lateral side 16 of the article of luggage such that the bottom surface 22 is substantially aligned with the bottom side 14. A pair of wheels 24 is provided and each of the wheels 24 is rotatably coupled to the platform 20. Each of the wheels 24 is positioned on the bottom surface 22 such that each of the wheels 24 may roll along a support surface 26. The support surface 26 may comprise a floor or the like.

A drive unit 28 is coupled to the article of luggage 12. The drive unit 28 engages the support surface 26. The drive unit 28 urges the article of luggage 12 along the support surface 26. Thus, the article of luggage 12 provides transportation when the platform 20 is ridden upon.

The drive unit 28 comprises a base 30 that is rotatably coupled to the bottom side 14 of the article of luggage 12. The base 30 is substantially coextensive with the second lateral side 18. A pair of rollers 32 is provided and each of the rollers 32 is rotatably coupled to the base 30. Each of the rollers 32 is positioned on an associated one of opposite ends of the base 30 such that each of the rollers 32 may roll along the support surface 26.

A pair of motors 34 is provided and each of the motors 34 is positioned within the base 30. Each of the motors 34 has an associated one of the rollers 32 rotatably coupled thereto. Each of the motor 34 rotates the associated roller 32 when the motors 34 are turned on. Thus, the drive unit 28 urges the article of luggage along the support surface 26. Each of the motors 34 may comprise an electrical motor or the like.

A handle 36 is rotatably coupled to the article of luggage 12. The handle 36 comprises a shaft 38 and a grip 40. The shaft 38 extends through the top side 15 and engages the base 30. The shaft 38 rotates the base 30 such that the handle 36 may steer the article of luggage 12 on the support surface 26. The shaft 38 has a distal end 42 with respect to the top side 15.

The shaft 38 has a plurality of slidable sections 44 such that the shaft 38 has a telescopically adjustable height. The shaft 38 has a hinged portion 45. Thus, the shaft 38 is positionable in a deployed position having the shaft 38 extending upwardly from the top side 15. The shaft 38 is positionable in a stored position having the shaft 38 extending along the top side 15.

Figure 6:
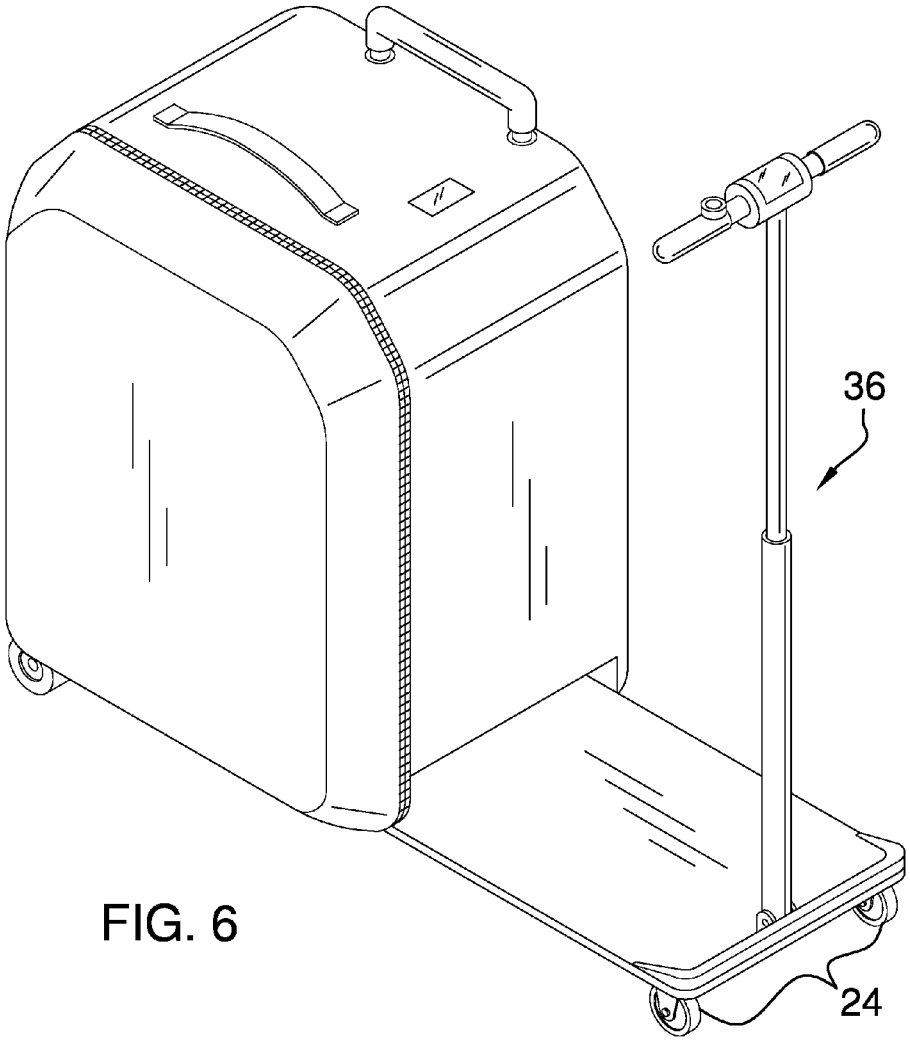
FIG. 6 is a perspective view of an alternative embodiment of the disclosure.
Figure 7:
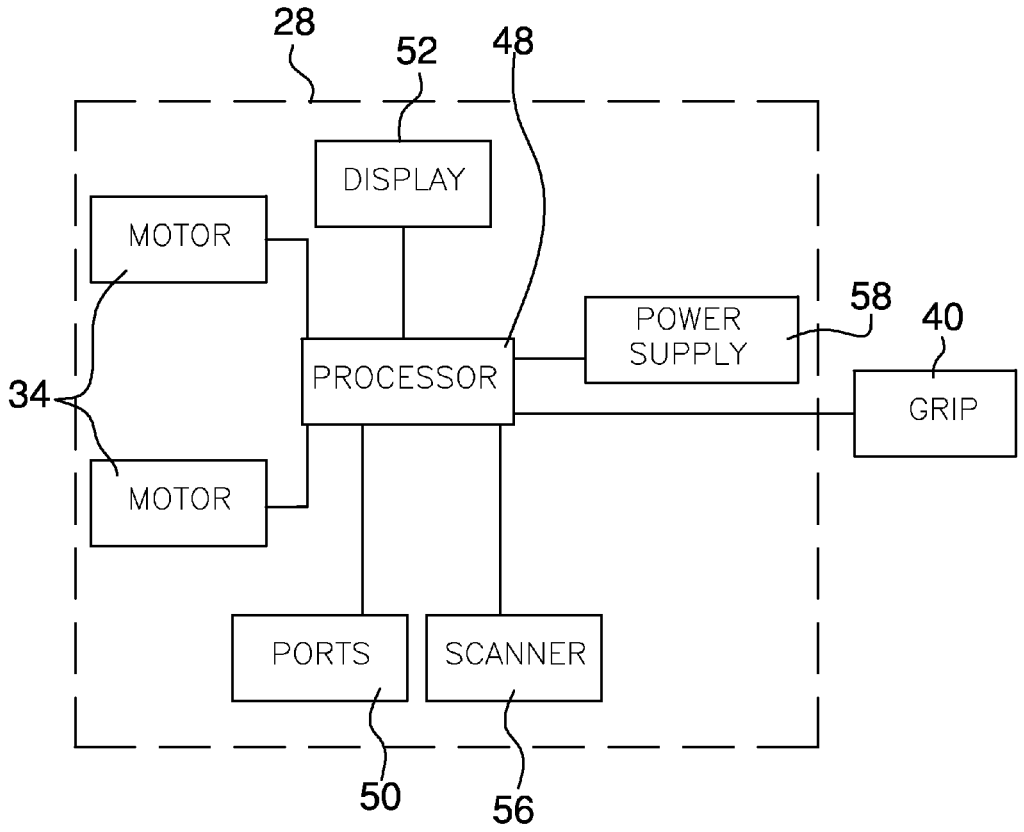
FIG. 7 is a schematic view of an embodiment of the disclosure.

The grip 40 is coupled to the distal end 42 such that the grip 40 may be gripped. The grip 40 is oriented perpendicular to the shaft 38 and the grip 40 has a throttle portion 46. The throttle portion 46 may be rotated about an axis extending through the grip 40. The throttle portion 46 is rotatable between an on position and an off position and throttle portion 46 may comprise a rheostatic control or the like. In an alternative embodiment 47 as shown in FIG. 6, the shaft 38 may be coupled to and extending upwardly from the platform 20.

A processor 48 is coupled to the base 30. The processor 48 is electrically coupled between each of the motors 34 and the throttle portion 46. The throttle portion 46 turns each of the motors 34 on and off. Additionally, the throttle portion 46 adjusts a speed of each of the motors 34 between a minimum speed and a maximum speed. The processor 48 may comprise an electronic processor or the like.

A plurality of ports 50 is provided and each of the ports 50 is coupled to the article of luggage 12. Each of the ports 50 is electrically coupled to the processor 48. Each of the ports 50 may be electrically coupled to an extrinsic electronic device. Each of the ports 50 may comprise a usb port or the like.

A display 52 is coupled to the grip 40 such that the display may be observed. The display 52 is electrically coupled to the processor 48. The display 52 displays operational parameters of the drive unit 28. The display 52 may comprise an LED or the like. An alert 54 is coupled to the grip 40 such that the alert 54 may be manipulated. The alert 54 issues an audible alarm thereby alerting individuals to the presence of the article of luggage 12. The alert 54 may comprise a bicycle bell or the like.

A scanner 56 is coupled to the top side 15 of the article of luggage 12. The scanner 56 is electrically coupled to the processor 48 and the scanner 56 is in electrical communication with an external communications network. The external communications network may comprise an airport departure and arrival system or the like. The scanner 56 may comprise a bar code scanner or the like. Additionally, the scanner 56 has wireless communication capabilities thereby facilitating the scanner 56 to communicate with the extrinsic communication network. Thus, the scanner 56 may scan an airline ticket such that gate information pertaining to the airline ticket is displayed on the display 52.

A power supply 58 is positioned within the base 30 and the power supply 58 is electrically coupled to the processor 48. The power supply 58 comprises at least one battery 60 and a power cord 62. The power cord 62 is electrically coupled to the at least one battery 60. The power cord 62 is extendable outwardly from the second lateral side 18. The power cord 62 may be electrically coupled to a power source thereby facilitating the at least one battery 60 to be charged. The power cord 62 comprises a retractable power cord such that the power cord 62 retracts into the article of luggage 12 when the power cord 62 is not in use.

In use, the platform 20 is slid outwardly from the article of luggage 12 and the platform 20 is ridden upon. The handle 36 is positioned in the deployed position and the throttle portion 46 is manipulated. The article of luggage 12 is urged along the support surface 26 such that said article of luggage 12 provides transportation. The article of luggage 12 may be ridden in an airport or other public area involving walking. The platform 20 is slid into the article of luggage 12 and the handle 36 is positioned in the stored position when the article of luggage 12 is not providing transportation.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A motorized luggage system comprising:

an article of luggage, said article of luggage having a top side, a bottom side, a first lateral side and a second lateral side;

a platform being slidably coupled to said article of luggage, said platform being extendable outwardly from said article of luggage wherein said platform is configured to be ridden upon; and a drive unit being coupled to said article of luggage wherein said drive unit is configured to engage a support surface, said drive unit urging said article of luggage wherein said article of luggage is configured to provide transportation when said platform is ridden upon, said drive unit including a base being rotatably coupled to said bottom side of said article of luggage, said base being substantially coextensive with said second lateral side.

2. The system according to claim 1, wherein said platform has a bottom surface, said platform being slidable outwardly from said first lateral side such that said bottom surface is substantially aligned with said bottom side of said article of luggage.

3. The system according to claim 2, further comprising a pair of wheels, each of said wheels being rotatably coupled to said platform, each of said wheels being positioned on a bottom surface of said platform wherein each of said wheels is configured to roll along a support surface.

4. The system according to claim 1, further comprising a pair of rollers, each of said rollers being rotatably coupled to said base, each of said rollers being positioned on an associated one of opposite ends of said base wherein each of said rollers is configured to roll along the support surface.

5. The system according to claim 4, further comprising a pair of motors, each of said motors being positioned within said base, each of said motors having an associated one of said rollers being rotatably coupled thereto, each of said motor rotating said associated roller when said motors are turned on wherein said drive unit is configured to urge said article of luggage along the support surface.

6. The system according to claim 5, further comprising a handle being rotatably coupled to said article of luggage, said handle comprising a shaft and a grip, said shaft extending through said top side and engaging said base such that said shaft rotates said base wherein said handle is configured to steer said article of luggage on the support surface, said shaft having a distal end with respect to said top side.

7. The system according to claim 6, wherein said shaft has a plurality of slidable sections such that said shaft has a telescopically adjustable height, said shaft having a hinged portion such that said shaft is positionable in a deployed position having said shaft extending upwardly from said top side, said shaft being positionable in a stored position having said shaft extending along said top side.

8. The system according to claim 7, wherein said grip is coupled to said distal end wherein said grip is configured to be gripped, said grip being oriented perpendicular to said shaft, said grip having a throttle portion wherein said throttle portion is configured to be rotated about an axis extending through said grip, said throttle portion being rotatable between an on position and an off position.

9. The system according to claim 1, further comprising:

a base;

a pair of motors;

a throttle portion; and a processor being coupled to said base, said processor being electrically coupled between each of said motors and said throttle portion such that said throttle portion turns each of said motors on and off.

10. The system according to claim 9, further comprising a plurality of ports, each of said ports being coupled to said article of luggage, each of said ports being electrically coupled to said processor, each of said ports being configured to be electrically coupled to an extrinsic electronic device.

11. The system according to claim 10, further comprising a power supply being positioned within said base, said power supply being electrically coupled to said processor, said power supply comprising at least one battery and a power cord, said power cord being electrically coupled to said at least one battery, said power cord being extendable outwardly from said second lateral side wherein said power cord is configured to be electrically coupled to a power source thereby facilitating said at least one battery to be charged.

12. A motorized luggage system comprising:

an article of luggage having a top side, a bottom side, a first lateral side and a second lateral side;

a platform being slidably coupled to said article of luggage, said platform being extendable outwardly from said article of luggage wherein said platform is configured to be ridden upon, said platform having a bottom surface, said platform being slidable outwardly from said first lateral side such that said bottom surface is substantially aligned with said bottom side of said article luggage;

a pair of wheels, each of said wheels being rotatably coupled to said platform, each of said wheels being positioned on said bottom surface wherein each of said wheels is configured to roll along a support surface; and a drive unit being coupled to said article of luggage wherein said drive unit is configured to engage the support surface, said drive unit urging said article of luggage wherein said article of luggage is configured to provide transportation when said platform is ridden upon, said drive unit comprising:

a base being rotatably coupled to said bottom side of said article of luggage, said base being substantially coextensive with said second lateral side, a pair of rollers, each of said rollers being rotatably coupled to said base, each of said rollers being positioned on an associated one of opposite ends of said base wherein each of said rollers is configured to roll along the support surface, a pair of motors, each of said motors being positioned within said base, each of said motors having an associated one of said rollers being rotatably coupled thereto, each of said motor rotating said associated roller when said motors are turned on wherein said drive unit is configured to urge said article of luggage along the support surface, a handle being rotatably coupled to said article of luggage, said handle comprising a shaft and a grip, said shaft extending through said top side and engaging said base such that said shaft rotates said base wherein said handle is configured to steer said article of luggage on the support surface, said shaft having a distal end with respect to said top side, said shaft having a plurality of slidable sections such that said shaft has a telescopically adjustable height, said shaft having a hinged portion such that said shaft is positionable in a deployed position having said shaft extending upwardly from said top side, said shaft being positionable in a stored position having said shaft extending along said top side, said grip being coupled to said distal end wherein said grip is configured to be gripped, said grip being oriented perpendicular to said shaft, said grip having a throttle portion wherein said throttle portion is configured to be rotated about an axis extending through said grip, said throttle portion being rotatable between an on position and an off position, a processor being coupled to said base, said processor being electrically coupled between each of said motors and said throttle portion such that said throttle portion turns each of said motors on and off, a plurality of ports, each of said ports being coupled to said article of luggage, each of said ports being electrically coupled to said processor, each of said ports being configured to be electrically coupled to an extrinsic electronic device; and a power supply being positioned within said base, said power supply being electrically coupled to said processor, said power supply comprising at least one battery and a power cord, said power cord being electrically coupled to said at least one battery, said power cord being extendable outwardly from said second lateral side wherein said power cord is configured to be electrically coupled to a power source thereby facilitating said at least one battery to be charged.

* * * * *